US011410806B2

(12) United States Patent
Okuda et al.

(10) Patent No.: US 11,410,806 B2
(45) Date of Patent: Aug. 9, 2022

(54) MAGNETIC CORE AND COIL COMPONENT

(71) Applicant: TDK CORPORATION, Tokyo (JP)

(72) Inventors: Nobuhiro Okuda, Tokyo (JP); Hiroyuki Matsumoto, Tokyo (JP); Kazuhiro Yoshidome, Tokyo (JP)

(73) Assignee: TDK CORPORATION, Tokyo (JP)

( * ) Notice: Subject to any disclaimer, the term of this patent is extended or adjusted under 35 U.S.C. 154(b) by 384 days.

(21) Appl. No.: 16/823,394

(22) Filed: Mar. 19, 2020

(65) Prior Publication Data

US 2020/0303105 A1 Sep. 24, 2020

(30) Foreign Application Priority Data

Mar. 20, 2019 (JP) ..... JP2019-053658

(51) Int. Cl.

| | |
|---|---|
| ***H01F 27/24*** | (2006.01) |
| ***H01F 1/20*** | (2006.01) |
| ***H01F 3/08*** | (2006.01) |
| *H01F 27/28* | (2006.01) |

(52) U.S. Cl.

CPC ..... *H01F 1/20* (2013.01); *H01F 3/08* (2013.01); *H01F 27/24* (2013.01); *H01F 27/28* (2013.01)

(58) Field of Classification Search

CPC ... H01F 1/20; H01F 3/08; H01F 27/24; H01F 27/28; H01F 1/15308; H01F 1/15333; H01F 2017/048; H01F 1/22; H01F 27/255; H01F 17/04

See application file for complete search history.

(56) References Cited

U.S. PATENT DOCUMENTS

| | | | | |
|---|---|---|---|---|
| 2012/0188049 | A1* | 7/2012 | Matsuura | C22C 33/02 336/212 |
| 2016/0293309 | A1* | 10/2016 | Inagaki | H01F 3/08 |
| 2018/0147625 | A1 | 5/2018 | Takahashi et al. | |

FOREIGN PATENT DOCUMENTS

| | | | | |
|---|---|---|---|---|
| CN | 102341869 A | * | 2/2012 | B22F 1/0062 |
| JP | 2004064895 A | * | 2/2004 | |
| JP | 6448799 B2 | | 1/2019 | |

* cited by examiner

*Primary Examiner* — Tuyen T Nguyen
(74) *Attorney, Agent, or Firm* — Oliff PLC

(57) ABSTRACT

The present invention relates to a magnetic core containing soft magnetic powder and a coil component using the magnetic core. The soft magnetic powder has particles each having at least one pore therein, and the number of pores present in a region of 2.5 mm square in a cross section of the magnetic core is 60×(η/80) or more and 10000×(η/80) or less, in which the volume packing density of the soft magnetic powder in the magnetic core is η%.

6 Claims, 2 Drawing Sheets

MAGNETIC CORE AND COIL COMPONENT

BACKGROUND OF THE INVENTION

Field of the Invention

The present invention relates to a magnetic core and a coil component.

Description of the Related Art

Transformers, choke coils, inductors and the like are known as coil components used in power supply circuits of various electronic devices. In the above coil components, miniaturization and high efficiency are required, and a magnetic core containing soft magnetic powder is widely used.

Japanese Patent No. 6448799 discloses a technique for suppressing the power loss (core loss) of the magnetic core by reducing the number of hollow particles in the soft magnetic powder constituting the magnetic core. However, the inventors have found that a sufficient DC bias characteristic cannot be obtained even if the number of hollow particles is reduced within the range shown in Japanese Patent No. 6448799.

SUMMARY OF THE INVENTION

The present invention has been made in view of the above circumstances, and an objective thereof is to provide a magnetic core having a high magnetic permeability and an excellent DC bias characteristic, and a coil component using the magnetic core.

In order to achieve the above objective, the magnetic core of the present invention is a magnetic core containing soft magnetic powder, wherein the soft magnetic powder has particles each having at least one pore therein, and the number of pores present in a region of 2.5 mm square in a cross section of the magnetic core is $60\times(\eta/80)$ or more and $10000\times(\eta/80)$ or less, in which the volume packing density of the soft magnetic powder in the magnetic core is $\eta$%.

As a result of intensive studies, the present inventors have found that, in the magnetic core, both high magnetic permeability and excellent DC bias characteristic can be achieved by adjusting the number of pores inside the particles contained in the soft magnetic powder to a predetermined ratio.

Preferably, the soft magnetic powder contains Fe as a main component.

Preferably, the average particle size of the soft magnetic powder is 1 μm or more and 100 μm or less. By setting the average particle size of the soft magnetic powder within the above range, the magnetic permeability of the magnetic core can be particularly increased.

Preferably, the soft magnetic powder contains amorphous metal particles each having at least one pore therein, and may contains amorphous metal particles without pores therein.

Preferably, the soft magnetic powder contains nanocrystalline metal particles each having at least one pore therein, and may contains nanocrystalline metal particles without pores therein.

As described above, the soft magnetic powder contains amorphous and/or nanocrystalline metal particles, and thereby the core loss of the magnetic core can be reduced.

The magnetic core of the present invention can be used as a part of a coil component. Besides, the coil component may be, for example, a transformer, a choke coil, an inductor, a reactor, or the like.

DETAILED DESCRIPTION OF THE PREFERRED EMBODIMENTS

Hereinafter, the present invention is described based on an embodiment, but the present invention is not limited to the following embodiment.

(Coil component)

Figure 1:
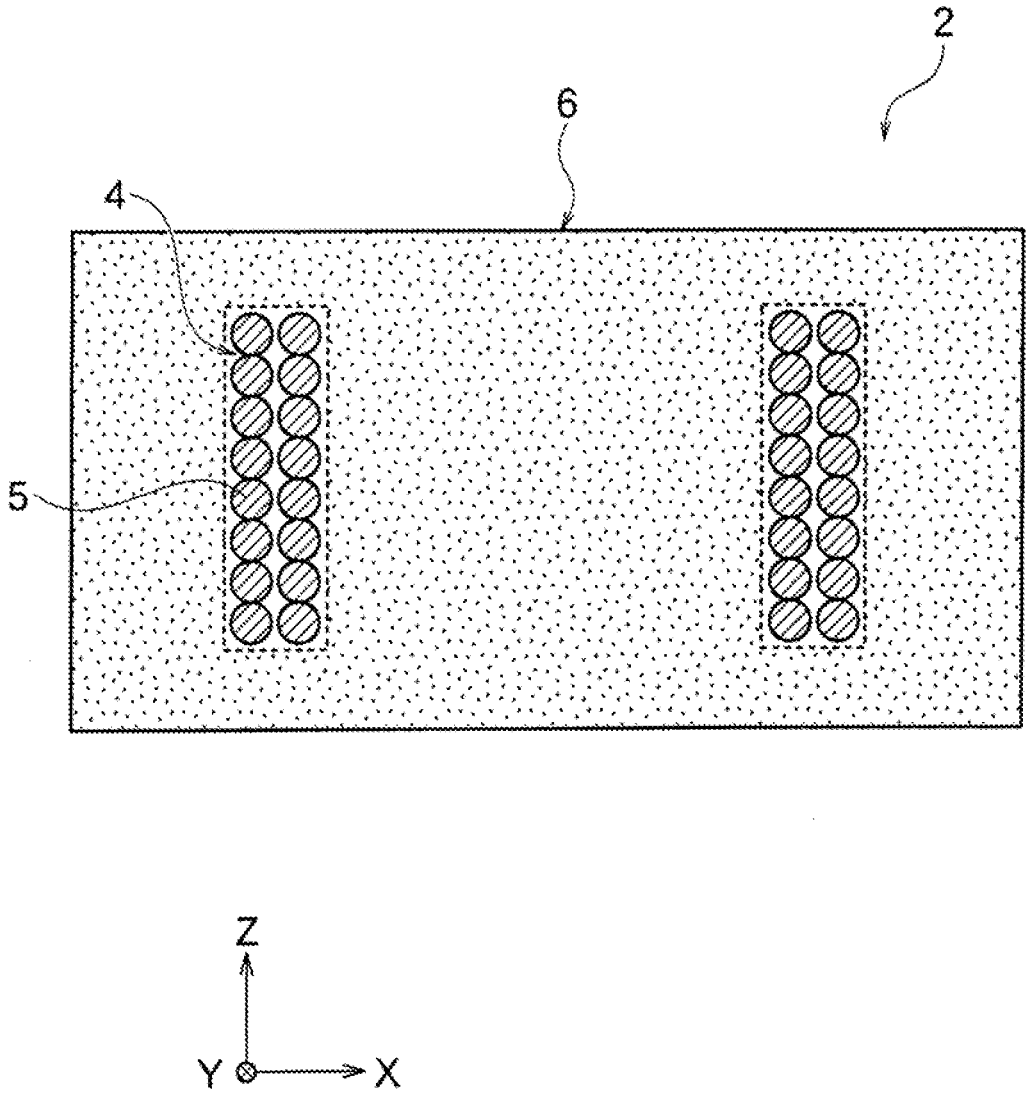
FIG. 1 is a schematic cross-sectional view of a coil component of one embodiment of the present invention.

A coil component 2 shown in FIG. 1 is exemplified as one embodiment of the coil component of the present invention. As shown in FIG. 1, the coil component 2 is configured by a winding part 4 and a magnetic core 6 and has a structure in which the winding part 4 is embedded inside the magnetic core 6. In addition, a conductor 5 is wound in a coil shape in the winding part 4.

(Magnetic core)

Figure 2:
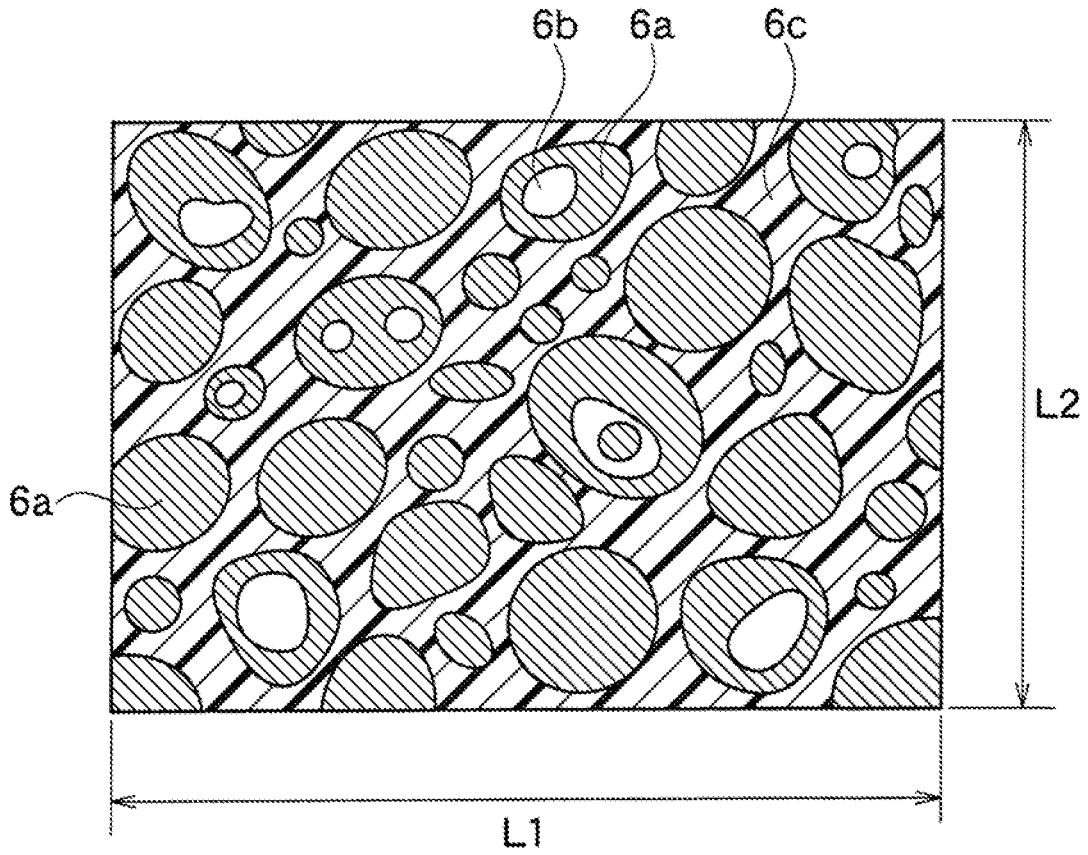
FIG. 2 is a schematic cross-sectional view of a main part at an arbitrary position of a magnetic core shown in FIG. 1.

The shape of the magnetic core 6 shown in FIG. 1 is arbitrary and not particularly limited, and examples of the shape include a columnar shape, an elliptical columnar shape, a prismatic shape, and the like. Then, as shown in FIG. 2, the magnetic core 6 is configured by soft magnetic powder 6*a* and a binder 6*c*. Besides, although not shown, an insulating film may be formed on each surface of the particles configuring the soft magnetic powder 6*a*, or voids or the like may be formed in the binder 6*c*.

(Soft magnetic powder)

As shown in FIG. 2, the soft magnetic powder 6*a* of the embodiment contain at least particles having at least one pore 6*b* therein and may contain particles having no pores. A plurality of pores 6*b* may be present in one particle, and the pore 6*b* may further contain small particles therein. Besides, the number of the particles containing a plurality of pores 6*b* is preferably 10% or less with respect to the total number of particles having at least one pore 6*b* therein.

In the embodiment, the number of the pores 6*b* in the magnetic core 6 is set within a predetermined range. Specifically, when the volume packing density of the soft magnetic powder 6*a* in the magnetic core 6 is $\eta$%, in an arbitrary cross section of the magnetic core 6, the number of the pores 6*b* present in a region of 2.5 mm square is $60\times(\eta/80)$ or more and $10000\times(\eta/80)$ or less, more preferably $1000\times(\eta/80)$ or more and $9000\times(\eta/80)$ or less. In the embodiment, by setting the number of the pores 6*b* in the magnetic core 6 within the above range, the magnetic permeability of the magnetic core 6 becomes high and the DC bias characteristic is also excellent.

The above numerical ranges (60-10000, 1000-9000) are values converted to the number of pores when the volume packing density is 80% so as to enable comparison with products having an arbitrary volume packing density. Accordingly, in a product having a volume packing density of $\eta$%, if the number of actually observed pores 6*b* is n, the number n may be multiplied by $(80/\eta)$ and then compared with the above numerical ranges. Besides, the amount of the pores 6*b* in the magnetic core 6 is specified according to the following procedure.

First, regarding the coil component as shown in FIG. 1, the coil component 2 is cut on any one of an X-Y plane, an X-Z plane, and a Y-Z plane to expose a cross section. Then, the cross section is mirror-polished with sandpaper and a buff which diamond paste are dropped, and then observed with a SEM or the like, and a cross-sectional photograph corresponding to the schematic diagram shown in FIG. 2 is taken. The cross-sectional photograph is preferably a back-scattered electron image. The dimension (L1×L2) of the cross section to be photographed may be appropriately determined according to the particle size of the soft magnetic powder 6*a*.

Next, the particles of the soft magnetic powder 6*a* in the cross-sectional photograph are specified by image analysis software or the like, and the number of the pores 6*b* present in the particles which have been image-recognized is counted. Besides, in the case of a SEM photograph, parts in which the contrast is bright are the particles of the soft magnetic powder 6*a*, and parts at which the contrast is dark inside the particles are the pores 6*b*. The counting of the number of the pores is performed in at least five visual fields or more. Then, the number of the pores 6*b* obtained in the measured area (L1×L2 x number of visual fields) is converted into the number in an area of 2.5 mm square (an area of 6.25 $mm^2$). And further converting the area conversion number to the number of the case when the volume packing density of the soft magnetic powder 6*a* is 80% (that is, multiplying by (80/η), the amount of the pores 6*b* (the number of the pores 6*b*) is obtained.

Besides, the volume packing density (η%) of the soft magnetic powder 6*a* in the magnetic core 6 is calculated from the density of the magnetic core 6 and the specific gravity of the soft magnetic powder 6*a*.

In addition, the size of the pores 6*b* is preferably 100 nm or more in diameter.

There may be pores 6*b* having a maximum size of about 90% with respect to the particle size of the soft magnetic powder. More preferably, the size of the pores 6*b* is about 10%-50% with respect to the particle size of the soft magnetic powder in an arbitrary cross section of the magnetic core. The size of the pores 6*b* is within the above range, and thereby both high magnetic permeability and excellent DC bias characteristic can be achieved in a more suitable range.

In the embodiment, the soft magnetic powder 6*a* may be composed of Mn—Zn-based ferrites or Ni—Zn-based ferrites, but is preferably composed of metal particles containing Fe as a main component. Examples of the metal particles containing Fe as a main component include, specifically, pure iron, Fe—Si-based (iron-silicon) alloys, permalloy-based (Fe—Ni) alloys, sendust-based (Fe—Si—Al; iron-silicon-aluminum) alloys, Fe—Si—Cr-based (iron-silicon-chromium) alloys, Fe—Si—Al—Ni-based alloys, Fe—Ni—Si—Co-based alloys, Fe-based alloy containing amorphous and/or nanocrystals, and the like. The Fe-based alloy containing amorphous and/or nanocrystals is particularly preferable.

In the embodiment, amorphous means not having regular atomic arrangement such as crystalline phase, and the Fe-based alloy containing amorphous may consist of amorphous only, or may have a nano-heterostructure in which the amorphous contains nanocrystals of 30 nm or less. The composition of the Fe-based alloys containing amorphous is arbitrary, for example, Fe—B-based alloys, Fe—B—C-based alloys, Fe—B—P-based alloys, Fe—B—Si-based alloys, Fe—B—Si—C-based alloys, Fe—B—Si—Cr—C-based alloys, and the like are exemplified.

In addition, in the embodiment, nanocrystal is a nano-order crystal of which the crystal particle size is 1 nm or more and 100 nm or less, and the nanocrystal is preferably a Fe-based nanocrystal having a bcc crystal structure (body-centered cubic lattice structure). The composition of the Fe-based nanocrystal in the embodiment is arbitrary; for example, a composition containing one or more elements selected from Nb, Hf, Zr, Ta, Mo, W and V in addition to Fe is exemplified.

In the case of a Fe-based alloy containing Fe-based nanocrystals, the composition thereof is arbitrary; for example, the Fe-based alloy may have a main component consisting of a composition formula $(Fe_{(1-(\alpha+\beta))}X1_{\alpha}X2_{\beta})(1-(a+b+c+d+e+f))M_aB_bP_cSi_dC_eS_f$;

wherein X1 may denote one or more elements selected from the group consisting of Co and Ni;

X2 may denote at least one element selected from the group consisting of Al, Mn, Ag, Zn, Sn, As, Sb, Cu, Cr, Bi, N, O and rare earth elements;

M may denote one or more elements selected from the group consisting of Nb, Hf, Zr, Ta, Mo, W, Ti and V; and $0.0 \le a \le 0.14$,
$0.0 \le b \le 0.20$,
$0.0 \le c \le 0.20$,
$0.0 \le d \le 0.14$,
$0.0 \le e \le 0.20$,
$0.0 \le f \le 0.02$,
$0.7 \le 1-(a+b+c+d+e) \le 0.93$,
$\alpha \ge 0$,
$\beta \ge 0$, and
$0 \le \alpha+\beta \le 0.50$ may be satisfied.

In the embodiment, by forming the soft magnetic powder 6*a* into metal particles containing amorphous and/or nanocrystals as described above, the effect of having the pores 6*b* can be obtained and the core loss can be reduced.

In addition, the average particle size of the soft magnetic powder 6*a* of the embodiment is preferably 1 μm or more and 100 μm or less, more preferably 10 μm or more and 50 μm or less. With the average particle size of the soft magnetic powder 6*a* within the above range, the magnetic permeability of the magnetic core 6 can be further increased. Besides, in the embodiment, when the soft magnetic powder 6*a* is Fe-based alloy particles containing Fe-based nanocrystals, the average crystal particle size of the Fe-based nanocrystals is preferably 5 nm or more and 30 nm or less.

In addition, in the embodiment, when the particles constituting the soft magnetic powder 6*a* are electrical conductors, it is preferable that the particles are insulated from each other. Examples of the insulating method include a method of forming an insulating film on the particle surface, a method of oxidizing the particle surface by heat treatment, and the like. In the case of forming an insulating film, the constituent materials of the insulating film include resin materials such as silicone resin and epoxy resin, or inorganic materials such as BN, $SiO_2$, MgO, $Al_2O_3$, phosphate, silicate, borosilicate, bismuthate and the like. By forming an insulating film on the particle surface, the insulating characteristic of each particle can be increased, and the withstand voltage of the coil component can be improved.

(Binder)

The binder 6*c* contained in the magnetic core 6 is not particularly limited, and examples thereof include thermosetting resin such as epoxy resin, phenol resin, melamine resin, urea resin, furan resin, alkyd resin, unsaturated polyester resin and diallyl phthalate resin, or thermoplastic resin such as polyamide, polyphenylene sulfide (PPS), polypropylene (PP) and liquid crystal polymer (LCP); water glass (sodium silicate); and the like.

The amount of the binder 6*c* is not particularly limited; for example, when the soft magnetic powder 6*a* is 100 parts by weight, the amount can be 1-5 parts by weight. In this case, the volume packing density η of the soft magnetic powder 6*a* contained in the magnetic core 6 is about 60%-92% in consideration of the existence of voids that may be included in the binder 6*c*.

Hereinafter, the soft magnetic powder 6*a* of the embodiment and the manufacturing method of the magnetic core 6 are described.

(Manufacturing method of soft magnetic powder)

The soft magnetic powder 6*a* of the embodiment is manufactured by, for example, a gas atomization method. In addition, a spinning water atomization process (SWAP method) can also be applied. The SWAP method is a method in which molten metal pulverized by gas atomization is supplied into spinning water and cooled, and it is preferable to select the SWAP method in order to obtain fine metal particles containing amorphous or nanocrystals.

In the gas atomization method, first, raw materials of the respective constituent elements are prepared according to the alloy type constituting the soft magnetic powder 6*a* and weighed so as to obtain a desired alloy composition after melting. Then, the weighed raw materials are melted and mixed to produce a mother alloy. Besides, in the above, there is no particular limitation on the method for melting; however, for example, the method of melting the raw materials by high-frequency heating after evacuation in a chamber is common.

Next, the produced mother alloy is heated and melted in a heat-resistant container to obtain molten metal. The temperature of the melted metal is not particularly limited and may be, for example, 1200-1500° C. Thereafter, the above molten metal is dropped from the heat-resistant container at a predetermined flow rate, and the molten metal is pulverized by injecting a high-pressure gas toward the dropped molten metal. The high-pressure gas used here is preferably an inert gas such as a nitrogen gas, an argon gas, a helium gas or the like, or a reducing gas such as an ammonia decomposition gas or the like.

It is considered that the pores 6*b* inside the particles in the soft magnetic powder 6*a* are formed by the molten metal taking in the high-pressure gas in the above pulverization step. Therefore, in the soft magnetic powder 6*a* obtained by gas atomization, the number of the pores 6*b* can be controlled particularly according to the ratio between the flow rate of the dropped molten metal and the pressure of the high-pressure gas. Alternatively, the number of the pores 6*b* can also be controlled according to conditions such as the diameter of a crucible nozzle, the diameter of a gas nozzle, the temperature of molten metal and the like.

If the flow rate of the dropped molten metal is kept constant and the gas pressure is lowered, the number of the pores 6*b* tends to decrease. In addition, if the gas pressure is higher with respect to the flow rate of molten metal, the number of the pores 6*b* tends to increase. Besides, the specific value of the flow rate of the molten metal or the gas pressure is appropriately determined by an atomization device to be used.

The molten metal pulverized in the above step is cooled in the chamber and solidified to form metal particles. The metal particles obtained in this manner are appropriately subjected to treatments such as classification, heat treatment, insulating film formation, and the like, and thereby the soft magnetic powder 6*a* used for manufacturing the magnetic core 6 is obtained. Besides, when the SWAP method is employed, in the gas atomization mechanism as described above, a cooling liquid layer on which a high-speed rotating water flow is generated is installed in a direction where the molten metal is pulverized and scattered, and the pulverized molten metal is quenched.

(Manufacturing of magnetic core)

The manufacturing method of magnetic core 6 is not particularly limited and a known method can be employed. For example, the following method is exemplified. First, the soft magnetic powder 6*a* and the binder 6*c* are mixed to obtain mixed powder. In addition, the obtained mixed powder may be made into granulated powder if necessary. Then, the mixed powder or the granulated powder is filled in a press mold and compression-molded. Besides, an air-core coil formed by winding the conductor 5 at a predetermined number of times is inserted into the press mold in advance. The magnetic core 6 with the winding part 4 embedded is obtained by performing a heat treatment on a molded body obtained in this manner. The conditions of the heat treatment are appropriately determined corresponding to the type of the binder 6*c* to be used. The magnetic core 6 obtained in this manner has the winding part 4 embedded therein, and thus functions as the coil component 2 when a voltage is applied to the winding part 4.

The embodiment of the present invention has been described above, but the present invention is not limited to the above embodiment and can be variously modified within the scope of the present invention. For example, the soft magnetic powder 6*a* contained in the magnetic core 6 may be configured by particles having a single composition, or may be configured by particles having different compositions. In addition, the particle size of the soft magnetic powder 6*a* may be formed by mixing particle groups having different average particle sizes.

Furthermore, the coil component 2 may be formed by combining a magnetic core consisting of a plurality of divided cores and a winding part, and fully compressing both. In addition, in the embodiment, the coil component 2 in which the winding part 4 is embedded inside the magnetic core 6 is illustrated, but the coil component may also be configured by winding the conductor 5 on the surface of the magnetic core 6 having a predetermined shape for a predetermined number of turns. In this case, examples of the shape of the magnetic core 6 include FT type, ET type, EI type, UU type, EE type, EER type, UI type, drum type, toroidal type, pot type, cup type, and the like.

Hereinafter, the present invention is described based on more detailed examples.

Examples 1-3

In the coil component of the present invention, a plurality of magnetic core samples was produced according to the following procedure in order to evaluate the characteristics of the soft magnetic powder having pores 6*b*.

First, metal particles having a composition of 83.9Fe-12.2Nb-2.0B-1.8P-0.1S were prepared using gas atomization. Besides, the flow rate of the molten metal and the gas pressure during the gas atomization are changed in Examples 1-3. In addition, the metal particles having the above composition obtained by the gas atomization were subjected to a heat treatment at 500° C. for 5 minutes to obtain metal particles containing Fe-based nanocrystals. Furthermore, an insulating film consisting of $SiO_2$-containing glass was coated on the surface of the metal particles, and the coated metal particles were used for manufacturing a magnetic core.

Next, the above metal particles and an epoxy resin diluted with acetone were kneaded, dried at room temperature for 24 hours, and then sized with a sieve having an aperture of 350 μm to obtain granules. Then, the granules were filled in a toroidal press mold and pressurized at a molding pressure of $5\times10^2$ MPa to obtain a molded body. The molded body was subjected to a heat treatment at 170° C. for 90 minutes in an air atmosphere to harden the epoxy resin and obtain a magnetic core sample.

Besides, the atomization conditions, the average particle size of the soft magnetic powder, and the volume packing density of the plurality of magnetic core samples obtained by the above steps are shown in the following Table 1. In addition, the dimensions of the magnetic core sample were 11 mm in outer diameter, 6.5 mm in inner diameter, and 2.5 mm in height; a coil was wound around the magnetic core and the following evaluation was performed.

(Evaluation)

Amount of pores

The content ratio of the pores in each magnetic core sample was evaluated by observing the cross section with a SEM. First, a magnetic core sample was fixed by a cold-embedded resin, and the cross section was cut out and subjected to mirror-polishing to thereby prepare a sample for SEM observation. Then, in the SEM observation, a cross-sectional photograph was taken in six visual fields with a backscattered electron image in the range of 250 μm (L1)× 180 μm (L2) (an area of 0.045 $mm^2$), and the number of pores inside the particles contained in this range was counted. The counted number was converted to the number in an area of 2.5 mm square (6.25 $mm^2$) (N1), and further converted to the number of the case when the volume packing density of the soft magnetic powder was converted to 80% to thereby obtain the number of pores (N2).

For example, when the volume packing density of the soft magnetic powder is 75% and the total number of observed pores is 60 (the total of six visual fields), the number of pores (N1, N2) is calculated by the following formula.

$$N1\ (\text{area conversion}) = 60\times(6.25/(0.045\times\text{six visual fields}))$$
$$\approx 1389/2.5\ \text{mm square}$$
$$N2\ (\text{packing density conversion}) = 1389\times(80/75) \approx 1482/2.5\ \text{mm square}$$

Besides, the average particle size of the soft magnetic powder was calculated by measuring the equivalent circle diameter of each particle contained in the above cross-sectional photograph.

Initial magnetic permeability (μi), DC magnetic permeability (μHdc), DC bias characteristic A LCR meter (4284A manufactured by Agilent Technologies Japan, Ltd) and a DC bias power supply (42841A manufactured by Agilent Technologies Japan, Ltd) were used to measure the inductance of the magnetic core at a frequency of 1 MHz and calculate the magnetic permeability of the magnetic core from the inductance. This measurement was performed at 0 A/m and in a case where a DC magnetic field of 8 kA/m was applied, the respective magnetic permeability was set to μi (0 A/m) and μHdc (8 kA/m), and the DC bias characteristic was evaluated with the values of μHdc (8 kA/m) and μHdc/μp. Besides, the reference value of μi was set to 40 for the magnetic permeability and the reference value of μHdc was set to 30 for the DC bias characteristic, and the case in which each numerical value was above the reference value was judged as good.

Comparative Examples 1-3

As a comparative example, an experiment was performed by changing the conditions of gas atomization from those of Examples 1-3, and magnetic core samples of Comparative Examples 1-3 having different content ratios of pores in the magnetic core were prepared. Besides, the other experimental conditions are the same as in Examples 1-3.

The evaluation results of Examples 1-3 and Comparative Examples 1-3 are shown in Table 1.

TABLE 1

| | Soft magnetic powder | | Atomization condition | | |
|---|---|---|---|---|---|
| | | | Flow rate of molten metal | Gas pressure | Average particle size |
| Sample No. | Composition type | Composition (wt %) | g/sec | MPa | μm |
| Example 1 | Nanocrystal | 83.9Fe—12.2Nb—2.0B—1.8P—0.1S | 50 | 5 | 25 |
| Example 2 | Nanocrystal | 83.9Fe—12.2Nb—2.0B—1.8P—0.1S | 20 | 5 | 15 |
| Example 3 | Nanocrystal | 83.9Fe—12.2Nb—2.0B—1.8P—0.1S | 5 | 2 | 35 |
| Comparative Example 1 | Nanocrystal | 83.9Fe—12.2Nb—2.0B—1.8P—0.1S | 5 | 1 | 50 |
| Comparative Example 2 | Nanocrystal | 83.9Fe—12.2Nb—2.0B—1.8P—0.1S | 5 | 1.5 | 42 |
| Comparative Example 3 | Nanocrystal | 83.9Fe—12.2Nb—2.0B—1.8P—0.1S | 10 | 10 | 8 |

TABLE 1-continued

| Sample No. | Packing density η % | Number of pores: N1 (after area conversion) /2.5 mm square | Number of pores: N2 (after packing density conversion) /2.5 mm square | Magnetic characteristic: Magnetic permeability μi 0 A/m | Magnetic characteristic: DC bias characteristic: μHdc 8 kA/m | Magnetic characteristic: DC bias characteristic: μHdc/μi |
|---|---|---|---|---|---|---|
| Example 1 | 82 | 2594 | 2530 | 63 | 38 | 0.60 |
| Example 2 | 79 | 7009 | 7097 | 45 | 32 | 0.71 |
| Example 3 | 77 | 98 | 101 | 70 | 31 | 0.44 |
| Comparative Example 1 | 75 | 19 | 21 | 80 | 22 | 0.28 |
| Comparative Example 2 | 75 | 54 | 58 | 79 | 24 | 0.31 |
| Comparative Example 3 | 72 | 11850 | 13167 | 30 | 24 | 0.80 |

As shown in Table 1, in Examples 1-3, the converted number of pores (N2) is in the range of 60-10000/2.5 mm square. On the contrary, in Comparative Examples 1-3, the converted number of pores (N2) falls out of the above range. If Example 3 is compared with Comparative Examples 1 and 2, confirmation can be made that, when the flow rate of the molten metal is constant, the number of pores tends to decrease as the gas pressure is low and the number of pores tends to increase as the gas pressure is high. In addition, from the results of Examples 1 and 2 and Comparative Example 3, confirmation can be made that, when the ratio of the gas pressure to the flow rate of the molten metal is high, the number of pores tends to increase.

In addition, regarding the magnetic characteristic, in Comparative Examples 1 and 2 in which the converted number of pores (N2) is 60/2.5 mm square or less, confirmation can be made that high magnetic permeability is obtained but the value of μHdc was lower than the value of μHdc in each example and sufficient DC bias characteristic has not been obtained. In Comparative Example 3 in which the number of pores (N2) is 10000/2.5 mm square or more, confirmation can be made that the ratio of μHdc/μi is high, but the magnetic permeability μi and μHdc are both below the reference value and sufficient magnetic permeability has not been obtained.

On the contrary, in Examples 1-3, confirmation could be made that the number of pores (N2) was in the range of 60-10000 and thereby the magnetic permeability μi and μHdc satisfied the reference value, and both high magnetic permeability and excellent DC bias characteristic could be achieved.

Examples 11-13

In Examples 11-13, soft magnetic powder produced under the same gas atomization conditions as in Example 1 was used and the pressure during formation was changed to produce magnetic core samples. Besides, the experiment conditions other than those described above were the same as in Example 1, and the same evaluation as in Example 1 was performed. The results are shown in Table 2.

Comparative Examples 11-16

In Comparative Examples 11-13, soft magnetic powder produced under the same gas atomization conditions as in Comparative Example 1 was used and the pressure during formation was changed to produce magnetic core samples. In addition, in Comparative Examples 14-16, soft magnetic powder produced under the same gas atomization conditions as in Comparative Example 3 was used and the pressure during formation was changed to produce magnetic core samples. Moreover, the experimental conditions other than those described above were the same as in Examples 11-13, and the same evaluation as in Examples 11-13 was performed. The results are shown in Table 2.

TABLE 2

| Sample No. | Soft magnetic powder: Composition type | Soft magnetic powder: Composition (wt %) | Molding pressure $\times 10^2$ MPa | Average particle size μm | Packing density η % |
|---|---|---|---|---|---|
| Example 11 | Nanocrystal | 83.9Fe—12.2Nb—2.0B—1.8P—0.1S | 10 | 25 | 90 |
| Example 12 | Nanocrystal | 83.9Fe—12.2Nb—2.0B—1.8P—0.1S | 5 | 25 | 82 |
| Example 13 | Nanocrystal | 83.9Fe—12.2Nb—2.0B—1.8P—0.1S | 1 | 25 | 76 |
| Comparative Example 11 | Nanocrystal | 83.9Fe—12.2Nb—2.0B—1.8P—0.1S | 10 | 50 | 80 |
| Comparative Example 12 | Nanocrystal | 83.9Fe—12.2Nb—2.0B—1.8P—0.1S | 5 | 50 | 75 |
| Comparative Example 13 | Nanocrystal | 83.9Fe—12.2Nb—2.0B—1.8P—0.1S | 1 | 50 | 64 |
| Comparative Example 14 | Nanocrystal | 83.9Fe—12.2Nb—2.0B—1.8P—0.1S | 10 | 8 | 77 |

TABLE 2-continued

| | | | | | |
|---|---|---|---|---|---|
| Comparative Example 15 | Nanocrystal | 83.9Fe—12.2Nb—2.0B—1.8P—0.1S | 5 | 8 | 72 |
| Comparative Example 16 | Nanocrystal | 83.9Fe—12.2Nb—2.0B—1.8P—0.1S | 1 | 8 | 60 |

| | Number of pores | | Magnetic characteristic | | |
|---|---|---|---|---|---|
| | N1 (after area conversion) | N2 (after packing density conversion) | Magnetic permeability | DC bias characteristic | |
| Sample No. | /2.5mm square | /2.5mm square | μi 0 A/m | μHdc 8 kA/m | μHdc/μi |
| Example 11 | 2929 | 2604 | 78 | 39 | 0.50 |
| Example 12 | 2594 | 2530 | 63 | 38 | 0.60 |
| Example 13 | 2422 | 2549 | 51 | 33 | 0.64 |
| Comparative Example 11 | 22 | 22 | 84 | 21 | 0.25 |
| Comparative Example 12 | 19 | 21 | 80 | 22 | 0.28 |
| Comparative Example 13 | 15 | 19 | 75 | 23 | 0.31 |
| Comparative Example 14 | 13466 | 13991 | 32 | 25 | 0.79 |
| Comparative Example 15 | 11850 | 13167 | 30 | 24 | 0.80 |
| Comparative Example 16 | 9992 | 13323 | 28 | 24 | 0.85 |

As shown in Table 2, in Comparative Examples 11-13, confirmation can be made that the volume packing density of the soft magnetic powder tends to increase as the molding pressure is increased. In addition, confirmation can also be made that the magnetic permeability μi tends to increase as the volume packing density increases. However, in Comparative Examples 11-13, the number of pores (N2) is small, and thus the value of μHdc hardly changes even if the volume packing density is increased, and the target value of the DC bias characteristics cannot be satisfied. In Comparative Examples 14-16, the same tendency as in Comparative Examples 11-13 is observed, but the number of pores (N2) is too large and thus the target value cannot be achieved for both the magnetic permeability μi and the DC bias characteristic.

On the other hand, in Examples 11-13, confirmation can be made that not only the magnetic permeability μi but also the magnetic permeability μHdc tend to increase as the volume packing density increases. In Example 13, the values of the magnetic permeability μi and μHdc are lower than those of the other Examples 11-12 because the volume packing density is low, but the number of pores (N2) is in the range of 60-10000/2.5 mm square, and thus both the magnetic permeability and the DC bias characteristic satisfy the reference value. Confirmation could be made that, as long as the number of pores was within the range of the present invention, the target magnetic permeability and DC bias characteristic could be satisfied even if the volume packing density was low.

Examples 21-37

In Examples 21-37, the type and the composition of the soft magnetic powder to be used were changed to produce magnetic core samples. The type and the composition of the soft magnetic powder in each example are shown in Table 3. Besides, configurations other than those shown in Table 3 were the same as in Example 1, and magnetic characteristics were evaluated in the same manner as in Example 1.

(Evaluation of core loss)

In addition, in Examples 21-37, evaluation of the core loss was performed in addition to the evaluation of the magnetic permeability and the DC bias characteristic. The core loss was measured using a BH analyzer (SY-8218 manufactured by Iwatsu Keisoku Co., Ltd.) under the conditions of a frequency of 500 kHz and a measurement magnetic flux density of 50 mT. The results are shown in Table 3.

TABLE 3

| | Soft magnetic powder | | Average particle size | Packing density η |
|---|---|---|---|---|
| Sample No. | Composition type | Composition (wt %) | μm | % |
| Example 21 | Nanocrystal | 83.9Fe—12.2Nb—2.0B—1.8P—0.1S | 25 | 82 |
| Example 22 | Nanocrystal | 83.4Fe—5.6Nb—2.0B—7.7Si—1.3Cu | 25 | 83 |
| Example 23 | Nanocrystal | 86.2Fe—12Nb—1.8B | 25 | 82 |
| Example 24 | Pure iron | Fe | 8 | 90 |
| Example 25 | Fe—Si | 97Fe—3Si | 15 | 91 |
| Example 26 | Fe—Si | 95.5Fe—4.5Si | 25 | 89 |
| Example 27 | Fe—Si | 93.5Fe—6.5Si | 25 | 83 |

TABLE 3-continued

| | | | | |
|---|---|---|---|---|
| Example 28 | Fe—Ni | 55Fe—45Ni | 24 | 82 |
| Example 29 | Fe—Ni | 16Fe—79Ni—5Mo | 24 | 82 |
| Example 30 | Fe—Si—Cr | 93.5Fe—4.5Si—2Cr | 16 | 90 |
| Example 31 | Fe—Si—Cr | 85.5Fe—4.5Si—10Cr | 16 | 90 |
| Example 32 | Fe—Si—Al | 85Fe—9.5Si—5.5Al | 25 | 86 |
| Example 33 | Fe—Si—Al—Ni | 87.4Fe—6.2Si—5.4Al—1Ni | 25 | 86 |
| Example 34 | Fe—Ni—Si—Co | 49Fe—44Ni—2Si—5Co | 27 | 86 |
| Example 35 | Amorphous | 86.8Fe—11Si—2.2B | 25 | 80 |
| Example 36 | Amorphous | 87.3Fe—7Si—2.5Cr—2.5B—0.7C | 25 | 81 |
| Example 37 | Amorphous | 94.6Fe—2Si—3B—0.4C | 25 | 80 |

| | Number of pores | | Magnetic characteristic | | | |
|---|---|---|---|---|---|---|
| | N1 (after area conversion) | N2 (after packing density conversion) | | Magnetic permeability | DC bias characteristic | |
| Sample No. | /2.5 mm square | /2.5 mm square | Core loss kW/m$^3$ | μi 0 A/m | μHdc 8 kA/m | μHdc/μi |
| Example 21 | 2594 | 2530 | 390 | 63 | 38 | 0.60 |
| Example 22 | 2811 | 2709 | 483 | 55 | 33 | 0.60 |
| Example 23 | 3590 | 3502 | 528 | 53 | 32 | 0.61 |
| Example 24 | 9875 | 8778 | 2811 | 45 | 34 | 0.75 |
| Example 25 | 5898 | 5185 | 6527 | 73 | 49 | 0.67 |
| Example 26 | 3459 | 3109 | 4452 | 66 | 46 | 0.70 |
| Example 27 | 3425 | 3301 | 4000 | 60 | 33 | 0.55 |
| Example 28 | 2979 | 2906 | 1793 | 56 | 46 | 0.82 |
| Example 29 | 3193 | 3115 | 1255 | 64 | 31 | 0.48 |
| Example 30 | 4775 | 4244 | 3533 | 85 | 40 | 0.47 |
| Example 31 | 5785 | 5142 | 3649 | 82 | 35 | 0.43 |
| Example 32 | 3322 | 3090 | 1732 | 88 | 30 | 0.34 |
| Example 33 | 3538 | 3291 | 1578 | 89 | 30 | 0.34 |
| Example 34 | 3068 | 2854 | 1756 | 134 | 30 | 0.23 |
| Example 35 | 2667 | 2667 | 1233 | 42 | 32 | 0.75 |
| Example 36 | 2711 | 2678 | 1170 | 42 | 32 | 0.75 |
| Example 37 | 2739 | 2739 | 1205 | 41 | 32 | 0.77 |

As shown in Table 3, confirmation could be made that all of Examples 21-37 satisfied the reference values of the magnetic permeability μi and μHdc. Accordingly, confirmation could be made that, even if the type of the soft magnetic powder was changed, both high magnetic permeability and excellent DC bias characteristic could be achieved as long as the converted number of pores (N2) was within the range of 60-10000/2.5 mm square.

In addition, in Examples 35-37 in which the soft magnetic powder containing amorphous is used, confirmation can be made that the core loss can be reduced compared with the other Examples 24-34. In addition, in Examples 21-23 in which the soft magnetic powder containing nanocrystals is used, the core loss can be further reduced compared with Examples 35-37. From these results, confirmation could be made that the use of metal particles containing amorphous and/or nanocrystals as the soft magnetic powder could further improve the magnetic characteristics of the magnetic core.

What is claimed is:

1. A magnetic core comprising soft magnetic powder, wherein the soft magnetic powder has particles each having at least one pore therein, and the number of pores present in a region of 2.5 mm square in a cross section of the magnetic core is 60×(η/80) or more and 10000×(η/80) or less, in which the volume packing density of the soft magnetic powder in the magnetic core is η%.

2. The magnetic core according to claim 1, wherein the soft magnetic powder comprises Fe as a main component.

3. The magnetic core according to claim 1, wherein the average particle size of the soft magnetic powder is 1 μm or more and 100 μm or less.

4. The magnetic core according to claim 1, wherein the soft magnetic powder comprises amorphous metal particles each having at least one pore therein.

5. The magnetic core according to claim 1, wherein the soft magnetic powder comprises nanocrystalline metal particles each having at least one pore therein.

6. A coil component having the magnetic core according to claim 1.

* * * * *